US008139006B2

(12) United States Patent
Ryu et al.

(10) Patent No.: US 8,139,006 B2
(45) Date of Patent: Mar. 20, 2012

(54) POWER SOURCE, DISPLAY INCLUDING THE SAME, AND ASSOCIATED METHOD

(75) Inventors: Do-Hyung Ryu, Suwon-si (KR); Do-Ik Kim, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 845 days.

(21) Appl. No.: 12/219,652

(22) Filed: Jul. 25, 2008

(65) Prior Publication Data

US 2009/0027375 A1 Jan. 29, 2009

(30) Foreign Application Priority Data

Jul. 27, 2007 (KR) ..... 10-2007-0075663

(51) Int. Cl.
*G09G 3/32* (2006.01)

(52) U.S. Cl. ..... 345/82

(58) Field of Classification Search ..... 345/36, 345/39, 45, 46, 76–84; 315/169.3; 327/108–112; 326/82–83; 313/486, 500, 505–507
See application file for complete search history.

(56) References Cited

U.S. PATENT DOCUMENTS

| | | | | |
|---|---|---|---|---|
| 6,518,962 | B2 | 2/2003 | Kimura et al. | |
| 7,847,783 | B2 * | 12/2010 | Liu et al. | 345/102 |
| 2005/0156829 | A1 * | 7/2005 | Choi et al. | 345/76 |
| 2006/0027822 | A1 | 2/2006 | Choi et al. | |
| 2008/0012804 | A1 * | 1/2008 | Kim et al. | 345/82 |
| 2009/0201281 | A1 * | 8/2009 | Routley et al. | 345/212 |

FOREIGN PATENT DOCUMENTS

| | | | |
|---|---|---|---|
| KR | 10-2000-0010923 | A | 2/2000 |
| KR | 10-2006-0012986 | A | 2/2006 |

* cited by examiner

*Primary Examiner* — Chanh Nguyen
*Assistant Examiner* — James Nokham
(74) *Attorney, Agent, or Firm* — Lee & Morse, P.C.

(57) ABSTRACT

A power source for applying a voltage to a pixel circuit, the power source including a sensing unit and a controlling unit. The sensing unit senses a current flowing through a power line coupled to the pixel circuit, the controlling unit increases a voltage applied to the power line by a first amount when the sensed current is lower than a reference, and the controlling unit decreases the voltage applied to the power line by a second amount when the sensed current is higher than the reference, the second amount being different from the first amount.

17 Claims, 5 Drawing Sheets

POWER SOURCE, DISPLAY INCLUDING THE SAME, AND ASSOCIATED METHOD

BACKGROUND OF THE INVENTION

1. Field of the Invention

Embodiments relate to a power source, a display including the same, and an associated method.

2. Description of the Related Art

In the manufacture and operation of a display, e.g., a display used to reproduce text, images, video, etc., uniform operation of pixel elements of the display is highly desirable. However, providing such uniform operation may be difficult. For example, in some display technologies, e.g., those utilizing organic light emitting diodes (OLEDs), operational characteristics, e.g., luminance, of the pixel elements may change over time. Further, for a color display having a plurality of different colored pixel elements, the operational characteristics of the differently colored pixel elements may change independently. Accordingly, there is a need for a display adapted to compensate for changes in the operational characteristics of pixel elements.

SUMMARY OF THE INVENTION

Embodiments are therefore directed to a power source, a display including the same, and an associated method, which substantially overcome one or more of the problems due to the limitations and disadvantages of the related art.

It is therefore a feature of an embodiment to provide a power source adapted to rapidly compensate for changes in a current flowing through a pixel element, and a display including the power source and an associated method.

It is therefore another feature of an embodiment to provide a power source adapted to independently compensate for changes in currents flowing through respective pixel elements, and a display including the power source and an associated method.

At least one of the above and other features and advantages may be realized by providing a power source for applying a voltage to a pixel circuit, the power source including a sensing unit and a controlling unit. The sensing unit may sense a current flowing through a power line coupled to the pixel circuit, the controlling unit may increase a voltage applied to the power line by a first amount when the sensed current is lower than a reference, and the controlling unit may decrease the voltage applied to the power line by a second amount when the sensed current is higher than the reference, the second amount being different from the first amount.

The first amount may be higher than the second amount, such that an absolute value of increments to the voltage applied to the power line is larger than an absolute value of decrements to the voltage applied to the power line. The power source may apply a first voltage to a first power line, and may apply a second voltage to a second power line, the first power line may be coupled to first pixel circuits corresponding to first light emitting elements for emitting a first color, and the second power line may be coupled to second pixel circuits corresponding to second light emitting elements for emitting a second color. The sensing unit may sense a first current flowing through the first power line, and may sense a second current flowing through the second power line, the controlling unit may compare the first sensed current to a first reference, and may compare the second sensed current to a second reference, the controlling unit controlling increases and decreases in the first and second voltages according to the comparisons, and the power source may include a converting unit that is controlled by the controlling unit, the converting unit increasing and decreasing the first and second voltages in response to the controlling unit.

The controlling unit may control the converting unit to increase the first voltage by the first amount when the first sensed current is less than the first reference, and the controlling unit may control the converting unit to increase the second voltage by the first amount when the second sensed current is less than the second reference. The controlling unit may control the converting unit to decrease the first voltage by the second amount when the first sensed current is greater than the first reference, and the controlling unit may control the converting unit to decrease the second voltage by the second amount when the second sensed current is greater than the second reference.

The power source may include a converting unit that is controlled by the controlling unit, the converting unit increasing and decreasing the voltage in response to the controlling unit, the sensing unit may include a resistor coupled between an output of the converting unit and the power line, the sensing unit may include an amplifier that outputs an output voltage corresponding to a voltage difference between two terminals of the resistor, and the controlling unit may receive the output voltage. The controlling unit may increase a signal transmitted to the converting unit when the sensed current is lower than the reference and may decrease the signal transmitted to the converting unit when the sensed current is higher than the reference, and the converting unit may increase and decrease the voltage applied to the power line in correspondence with increases and decreases in the signal transmitted by the controlling unit.

At least one of the above and other features and advantages may also be realized by providing a display, including a pixel circuit, and a power line coupled between the pixel circuit and a power source, the power source including a sensing unit and a controlling unit. The sensing unit may sense a current flowing through the power line, the controlling unit may increase a voltage applied to the power line by a first amount when the sensed current is lower than a reference, and the controlling unit may decrease the voltage applied to the power line by a second amount when the sensed current is higher than the reference, the second amount being different from the first amount.

The first amount may be higher than the second amount, such that an absolute value of increments to the voltage applied to the power line is larger than an absolute value of decrements to the voltage applied to the power line. The power source may apply a first voltage to a first power line, and may apply a second voltage to a second power line, the first power line may be coupled to first pixel circuits corresponding to first light emitting elements for emitting a first color, and the second power line may be coupled to second pixel circuits corresponding to second light emitting elements for emitting a second color.

The sensing unit may sense a first current flowing through the first power line, and may sense a second current flowing through the second power line, and the controlling unit may compare the first sensed current to a first reference, and may compare the second sensed current to a second reference, the controlling unit controlling increases and decreases in the first and second voltages according to the current comparisons, and may further include a converting unit may be controlled by the controlling unit, the converting unit increasing and decreasing the first and second voltages in response to the controlling unit. The controlling unit may control the converting unit to increase the first voltage by the first amount when the first sensed current is less than the first reference, and the controlling unit may control the converting unit to increase the second voltage by the first amount when the second sensed current is less than the second reference. The controlling unit may control the converting unit to decrease the first voltage by the second amount when the first sensed current is greater than the first reference, and the controlling unit may control the converting unit to decrease the second voltage by the second amount when the second sensed current is greater than the second reference.

At least one of the above and other features and advantages may also be realized by providing a method of controlling a voltage applied to a pixel circuit, the method including sensing a current flowing through a power line coupled between a power source and the pixel circuit, increasing the voltage applied to the power line by a first amount when the sensed current is lower than a reference, and decreasing the voltage applied to the power line by a second amount when the sensed current is higher than the reference, the second amount being different from the first amount.

The first amount may be higher than the second amount, such that an absolute value of increments to the voltage applied to the power line is larger than an absolute value of decrements to the voltage applied to the power line. A first voltage may be applied to a first power line, a second voltage may be applied to a second power line, the power source may be coupled to the first power line, the first power line being coupled to first pixel circuits that correspond to first light emitting elements for emitting a first color, and the power source may be coupled to the second power line, the second power line being coupled to second pixel circuits corresponding to second light emitting elements for emitting a second color.

Sensing the current may include sensing a first current flowing through the first power line and sensing a second current flowing through the second power line. The method may further include comparing the first sensed current to a first reference, comparing the second sensed current to a second reference, and controlling increases and decreases in the first and second voltages according to the comparisons. The first voltage may be increased by the first amount when the first sensed current is less than the first reference, and the second voltage may be increased by the first amount when the second sensed current is less than the second reference. The first voltage may be decreased by the second amount when the first sensed current is greater than the first reference, and the second voltage may be decreased by the second amount when the second sensed current is greater than the second reference.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION OF THE INVENTION

Figure 1:
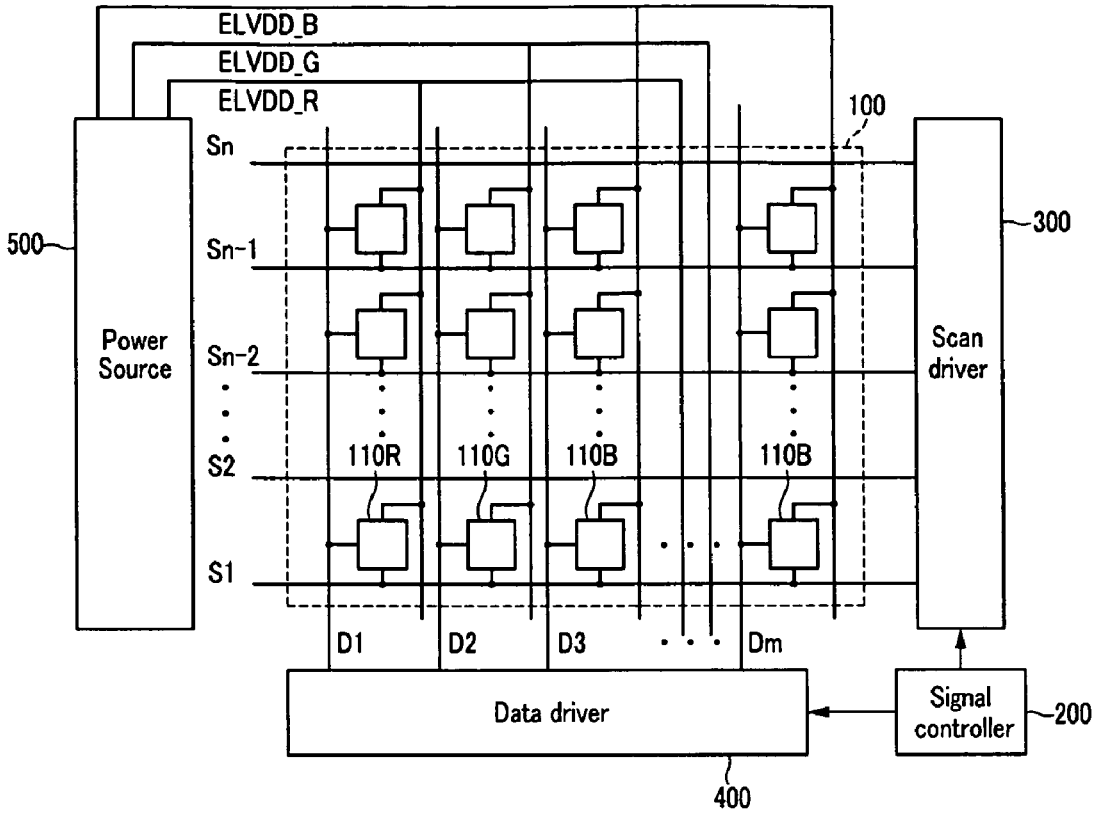
FIG. 1 illustrates a schematic diagram of a color display according to a first example embodiment.

Korean Patent Application No. 10-2007-0075663, filed on Jul. 27, 2007, in the Korean Intellectual Property Office, and entitled: "Organic Light Emission Diode Display and Driving Method Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated, or elements may be omitted, for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Similarly, where an element is described as being coupled to a second element, the element may be directly coupled to second element, or may be indirectly coupled to second element via one or more other elements. Further, where an element is described as being coupled to a second element, it will be understood that the elements may be electrically coupled, e.g., in the case of transistors, capacitors, power sources, nodes, etc. Like reference numerals refer to like elements throughout.

FIG. 1 illustrates a schematic diagram of a color display according to a first example embodiment. Referring to FIG. 1, the display may include, e.g., a display unit 100, a signal controller 200, a scan driver 300, a data driver 500, and a power source 400. The display may be, e.g., a display having electroluminescent pixel elements such as OLEDs.

The display unit 100 may include a plurality of data lines D1 to Dm, which may extend in a column direction, and a plurality of scan lines S1 to Sn, which may extend in a row direction. The display unit 100 may also include power lines ELVDD that provide a voltage from the power source 400 to pixel circuits 110. In an implementation, respective power lines ELVDD may be provided for pixel circuits 100 driving different colors. For example, respective power lines ELVDD_R, ELVDD_G, and ELVDD_B may be provided for pixel circuits 110R, 110G, and 110B. The data lines D1 to Dm may transmit data signals, e.g., signals corresponding to a video signal, to the pixel circuits 110R, 110G, and 110B. The scan lines S1 to Sn may transmit selection signals to the pixel circuits 110R, 110G, and 110B.

Figure 2:
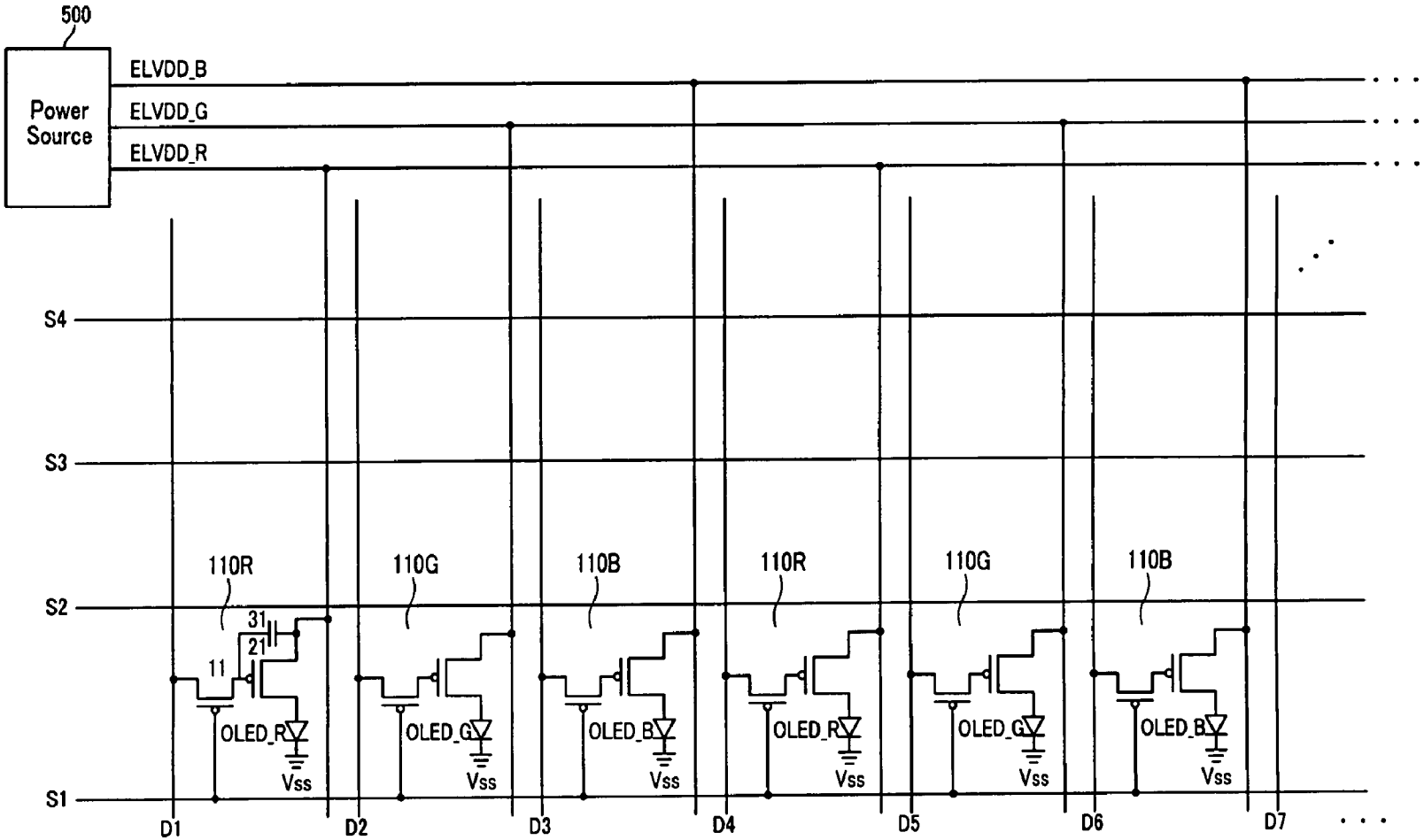
FIG. 2 illustrates a schematic diagram of pixel circuits in the display of FIG. 1.

A logical pixel, i.e., a pixel defining a display resolution, may include a plurality of sub-pixels including pixel circuits 110. In an implementation, a logical pixel may include three sub-pixels, each displaying one of red, green, and blue, and having pixel circuits 110R, 110G, and 110B, respectively. The display may present a desired color using spatial and/or temporal variations. When a color is expressed by temporally combining colors, a logical pixel may alternately display red, green, and blue with respect to time. When color is expressed by spatially combining colors, the sub-pixels, e.g., red, green, and blue sub-pixels, may be alternately arranged in a row or a column direction. For example, red, green, and blue sub-pixels may be alternately arranged in the column direction, as illustrated in FIGS. 1 and 2. In another implementation, the respective sub-pixels may be arranged in some other pattern, e.g., a pattern in which three differently colored sub-pixels are located at respective angular points of a triangle.

The signal controller 200 may divide one frame into a plurality of sub-frames, and may convert a video signal into data indicating a light emitting/non-light emitting state in each sub-frame. Grayscales may be expressed by light emission of a combination of sub-frames. The scan driver 300 may sequentially generate and apply a selection signal to the respective scan lines S1 to Sn for each sub-frame. The data driver 500 may generate a data signal corresponding to the video signal for each frame and apply it to the data lines D1 to Dm. The data signal may have a first voltage level corresponding to a light emitting state, i.e., an on-voltage for emitting light in the corresponding sub-pixel, when the data converted by the signal controller 200 indicates the light emitting state. The data signal may have a second voltage level corresponding to a non-light emitting state, i.e., an off-voltage so that the corresponding sub-pixel does not emit light, when the converted data indicates the non-light emitting state. In an implementation, e.g., in the case of an electroluminescent display such as an OLED display in which the light emitting elements have different levels of luminous efficiency according their respective colors, the on-voltage may be controlled according to the color of the emitted light.

The power source 400 may apply a power source voltage for the pixel circuits to one or more power lines. For example, the power source 400 may apply respective voltages to power lines ELVDD_R, ELVDD_G, and ELVDD_B, which supply pixel circuits 110R, 110G, and 110B with power for light emission. Referring to FIGS. 1 and 2, the pixel circuits 110R, 110G, and 110B having different colors may be coupled to the respective power lines ELVDD_R, ELVDD_G, and ELVDD_B.

The signal controller 200, the scan driver 300, and/or the data driver 500 may be electrically coupled to the display unit 100. They may be provided in the form of chips that are mounted on a tape carrier package (TCP) electrically coupled to the display unit 100. Alternatively, the scan driver 200, data driver 300, and/or the data driver 500 may be mounted on a flexible printed circuit (FPC) or a film that is electrically coupled to the display unit 100. In other implementations, the signal controller 200, the scan driver 300, and/or the data driver 500 may be directly mounted on a glass substrate of the display unit 100, they may be implemented as one or more driving circuits formed on a same substrate as the scan lines, data lines, light emitting control lines, and thin film transistors, or they may be directly mounted.

FIG. 2 illustrates a schematic diagram of pixel circuits in the display of FIG. 1. Referring to FIG. 2, the first power line ELVDD_R may be coupled to the red color pixel circuit 110R, the second power line ELVDD_G may be coupled to the green color pixel circuit, and the third power line ELVDD_B may be coupled to the blue color pixel circuit 110. In an implementation, each of the pixel circuits 110R, 110G, and 110B may include first and second transistors 11 and 21, a capacitor 31, and an organic light emitting element, e.g., OLED_R, OLED_G, or OLED_B. For clarity of illustration, these details are shown only for the red pixel circuit 110R, although it will be appreciated that each pixel circuit 110 may have the same structure.

The display may employ voltage programming or current programming. The pixel circuits 110 may be driven using a constant voltage technique. In some cases, e.g., where an electroluminescent element such as an OLED is employed, one or more of the electroluminescent elements may exhibit operational characteristics that change over time. For example, an OLED may exhibit a resistance that increases according to its light emitting time. Where a constant voltage driving technique is employed, such an increased resistance may reduce the current flowing through the OLED, such that the luminance is reduced as the amount of light emitting time increases. Thus, luminance of the display may be reduced as luminous efficiency of the OLED decreases with the passage of time. Since a linear area of a driving transistor is used in a digital driving method for expressing grayscales by a combination of sub-frames, variations in efficiency of the OLED may be problematic.

In the particular implementation illustrated in FIG. 2, the transistors 11 and 21 are shown as p-channel metal oxide semiconductor (PMOS) transistors having two electrodes, i.e., a source electrode and a drain electrode, and a gate electrode that is a control electrode. It will be appreciated that other transistors, e.g., NMOS, may also be used with corresponding changes in signals and power supplies.

As noted above, each of the plurality of pixel circuits 110R, 110G, and 110B may have the same configuration. The pixel circuit 110R in FIG. 2 will now be described. The pixel circuit 110R may be coupled to the first scan line S1 and the first data line D1. In the pixel circuit 110R, the gate electrode of the first transistor 11 may be coupled to the first scan line S1, the drain electrode of the first transistor 11 may be coupled to the first data line D1, and the source electrode of the first transistor 11 may be coupled to the gate electrode of the second transistor 21. The drain electrode of the second transistor 21 may be coupled to the first power line ELVDD_R, and the capacitor 31 may be coupled between the gate electrode of the second transistor 21 and the drain electrode of the second transistor 21. An anode of the organic light emitting element OLED_R may be coupled to the source electrode of the second transistor 21, and a cathode of the organic light emitting element OLED_R may be coupled to a power source Vss for supplying a voltage, e.g., a voltage lower than that of the first power line ELVDD_R.

When a selection signal of a low level is applied to the first scan line S1 and the first transistor 11 is turned on for each sub-frame, the data signal indicating the light emitting state in the corresponding sub-frame may be transmitted to the gate electrode of the second transistor 21 from the first data line D1. Where the data signal has an on-voltage indicating a light emitting state, the capacitor 31 may be charged with a voltage corresponding to a difference between a power source voltage applied to the drain electrode of the second transistor 21, via the power line ELVDD_R, and the on-voltage applied to the gate electrode of the second transistor 21. The second transistor 21 may supply a current proportional to the voltage between the drain electrode and the gate electrode to the organic light emitting element OLED_R, such that the organic light emitting element OLED_R emits light. When the data signal is an off-voltage indicating a non-light emitting state, the voltage between the drain electrode and the gate electrode may not reach a threshold voltage of the second transistor 21, such that no current is supplied to the organic light emitting element OLED_R. Thus, a voltage difference between the drain electrode and the gate electrode of the second transistor 21 may be required to increase beyond a predetermined voltage in order for the organic light emitting element OLED_R to emit light with a predetermined luminance level.

A large current may continuously flow to the OLEDs, and therefore the OLEDs may deteriorate as time passes. Further, OLEDs of different colors may deteriorate at different rates. This problem is addressed in the display unit 100 by controlling the power source voltage and, in particular, by sensing current flow that is indicative of deterioration of the OLEDs, and compensating the power source voltage to offset such deterioration. Further, the display unit 100 may quickly compensate the power source voltage by adjusting the voltage rapidly to a point that is equal to or in excess of a predetermined voltage and, if necessary, adjusting the voltage back towards the predetermined voltage at a less rapid rate. Accordingly luminous efficiency of OLEDs or other electroluminescent pixel elements may be quickly compensated.

Figure 3:
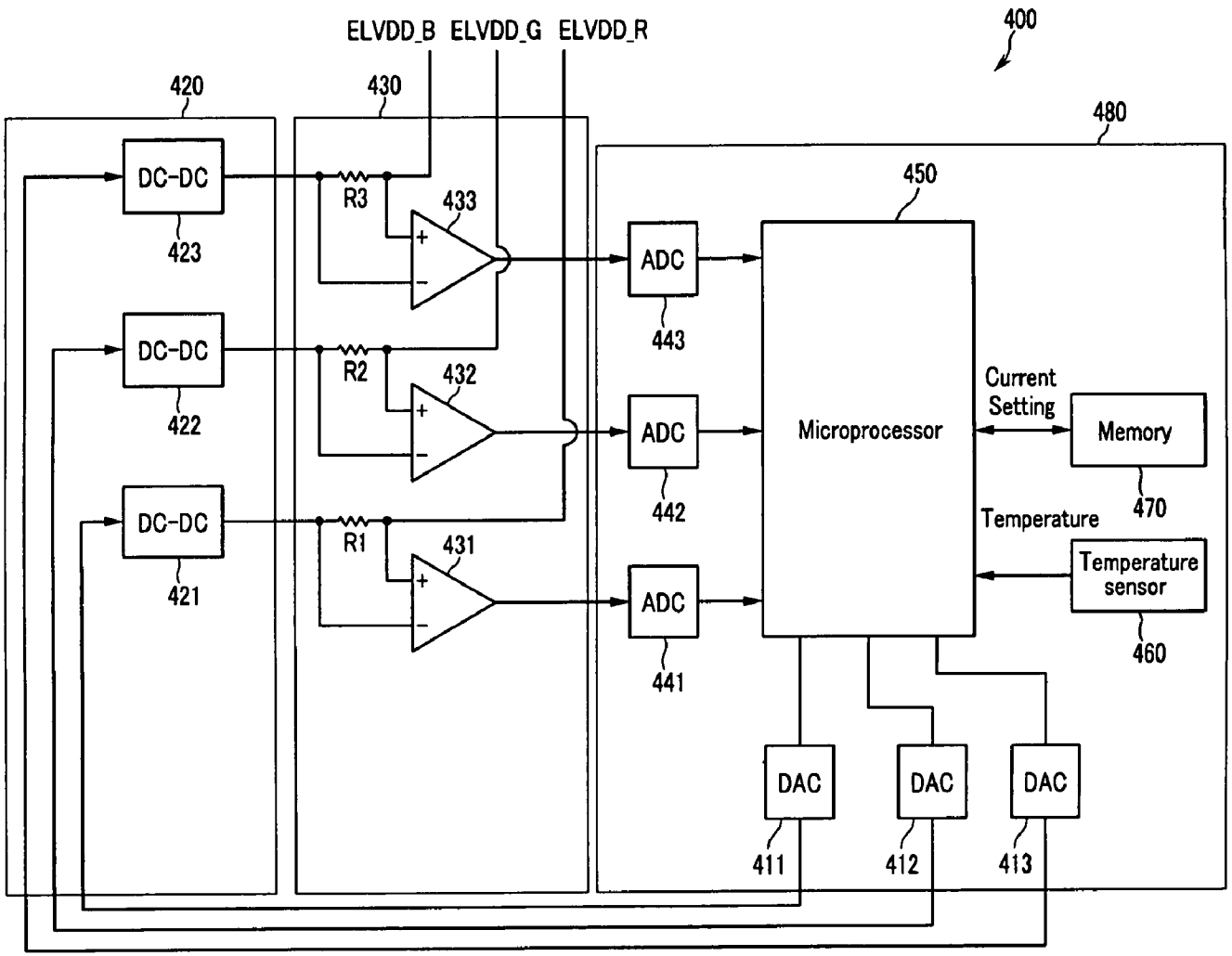
FIG. 3 illustrates a schematic diagram of a power source according to a second example embodiment.

FIG. 3 illustrates a schematic diagram of the power source 400 according to a second example embodiment. The power source 400 may include a converting unit 420, a sensing unit 430, and a controlling unit 480. The converting unit 420 may include a plurality of DC-DC converters (direct current-to-direct current converters) DC-DC 421, 422, and 423. The DC-DC converters DC-DC 421, 422, and 423 may respectively correspond to red, green, and blue pixel circuits 110R, 110G, and 110B, and may supply the power source voltage for the corresponding color to the respective power lines ELVDD_R, ELVDD_G, and ELVDD_B shown at the top of FIG. 3. In further detail, the first DC-DC converter 421 may generate the power source voltage corresponding to red, and may transmit the power source voltage to the first power line ELVDD_R through the sensing unit 430. The second DC-DC converter 422 may generate the power source voltage corresponding to green, and may transmit the power source voltage to the second power line ELVDD_G through the sensing unit 430. The third DC-DC converter 423 may generate the power source voltage corresponding to blue, and may transmit it to the third power line ELVDD_B through the sensing unit 430.

The sensing unit 430 may sense respective currents flowing between the converting unit 420 and the power lines ELVDD_R, ELVDD_G, and ELVDD_B. The sensing unit 430 may output respective voltages corresponding to the sensed red, green, and blue currents. The sensing unit 430 may include differential amplifiers 431, 432, and 433, and resistors R1, R2, and R3, which respectively correspond to red, green, and blue. In further detail, the resistor R1 may be coupled between the first DC-DC converter 421 and the first power line ELVDD_R, and a voltage drop across both terminals of the resistor R1, which is related to the current flowing through the resistor R1, may be input to the first differential amplifier 431. The first differential amplifier 431 may amplify a voltage difference across the two terminals of the resistor R1, and may transmit the amplified voltage to the controlling unit 480. In a like manner, the second differential amplifier 432 may amplify a voltage difference across the two terminals of the resistor R2, which is related to the current flowing through the second resistor R2, and may transmit the amplified voltage to the controlling unit 480. The third differential amplifier 433 may amplify a voltage difference across the two terminals of the resistor R3, which is related to the current flowing through the third resistor R3, and may transmit the amplified voltage to the controlling unit 480. Thus, the controlling unit 480 may receive as inputs voltages indicative of the respective currents flowing through the resistors R1, R2, and R3, which correspond to the currents flowing through the first, second and third power lines ELVDD_R, ELVDD_G, and ELVDD_B.

The controlling unit 480 may include digital-analog converters DAC 411, 412, and 413 respectively corresponding to red, green, and blue. The controlling unit 480 may further include a plurality of analog-digital converters ADC 441, 442, and 443 respectively corresponding to red, green, and blue, as well as a microprocessor 450 and a memory 470. The ADCs 441, 442, and 443 may convert the amplified voltages respectively received from the corresponding differential amplifiers 431, 432, and 433 into digital signals for red, green, and blue, and may transmit the digital signals to the microprocessor 450. The microprocessor 450 may compare each of the digital signals to a corresponding reference value, i.e., a reference value representing a corresponding red, green, or blue reference current. Based on the comparisons, the microprocessor 450 may then generate red, green, and blue control signals for controlling the power source voltages applied to the red, green, and blue power lines ELVDD_R. ELVDD_G, and ELVDD_B. The red, green, and blue reference values may be stored in the memory 470.

Each of the DACs 411, 412, and 413 respectively corresponding to red, green, and blue may convert the red, green, and blue digital control signals received from the microprocessor 450 into red, green, and blue analog control voltages, and may transmit the analog control voltages to the converters DC-DC 421, 422, and 423, respectively.

In an implementation, the controlling unit 480 may further include a temperature sensor 460 for sensing an ambient temperature. The microprocessor 450 may control the power source voltages according to the ambient temperature in addition to controlling the power source voltages as described above.

A method for controlling the power source voltage in the power source 400 shown in FIG. 3 will now be described with reference to FIGS. 4 and 5. The following description will particularly describe control of the power source voltage corresponding to one color. The method may be applied in the same manner to various colors, e.g., red, green, and blue.

Figure 4:
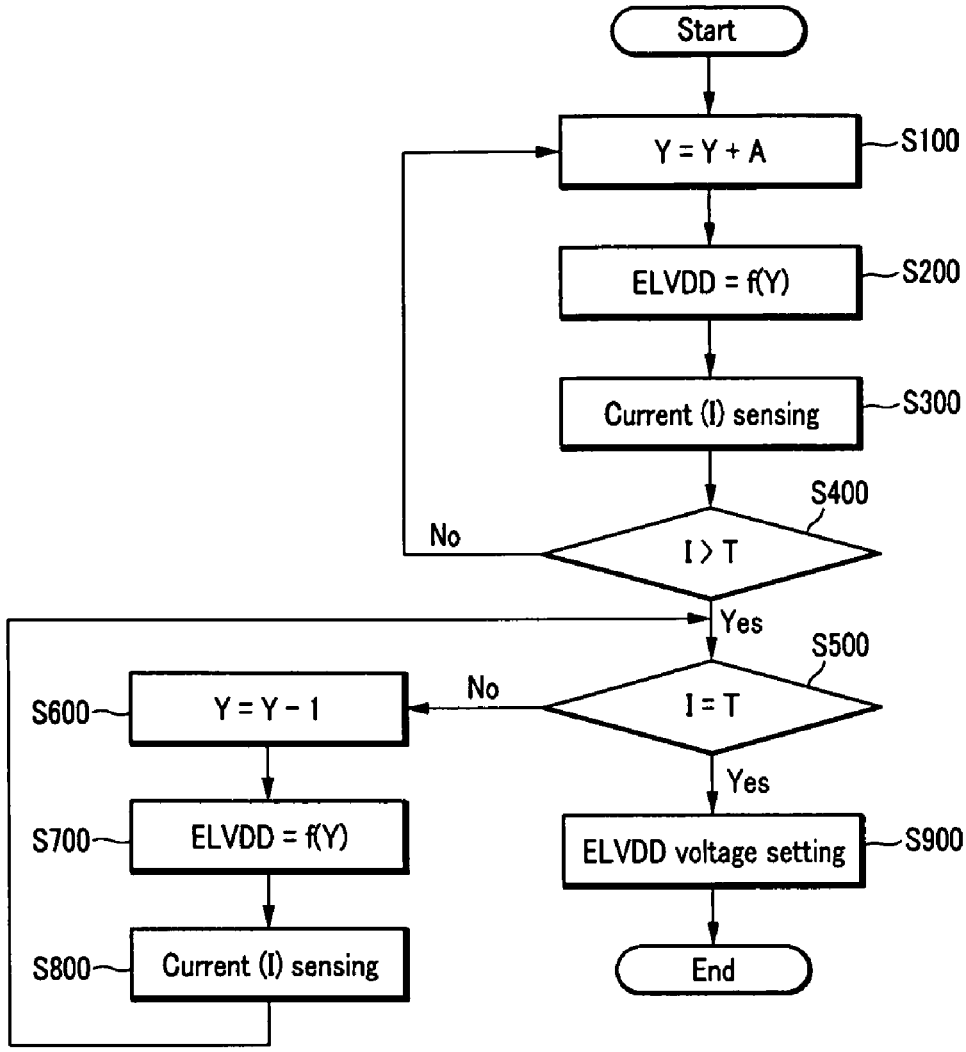
FIG. 4 illustrates a flowchart of operations in a method of controlling a power source according to a third example embodiment.
Figure 5:
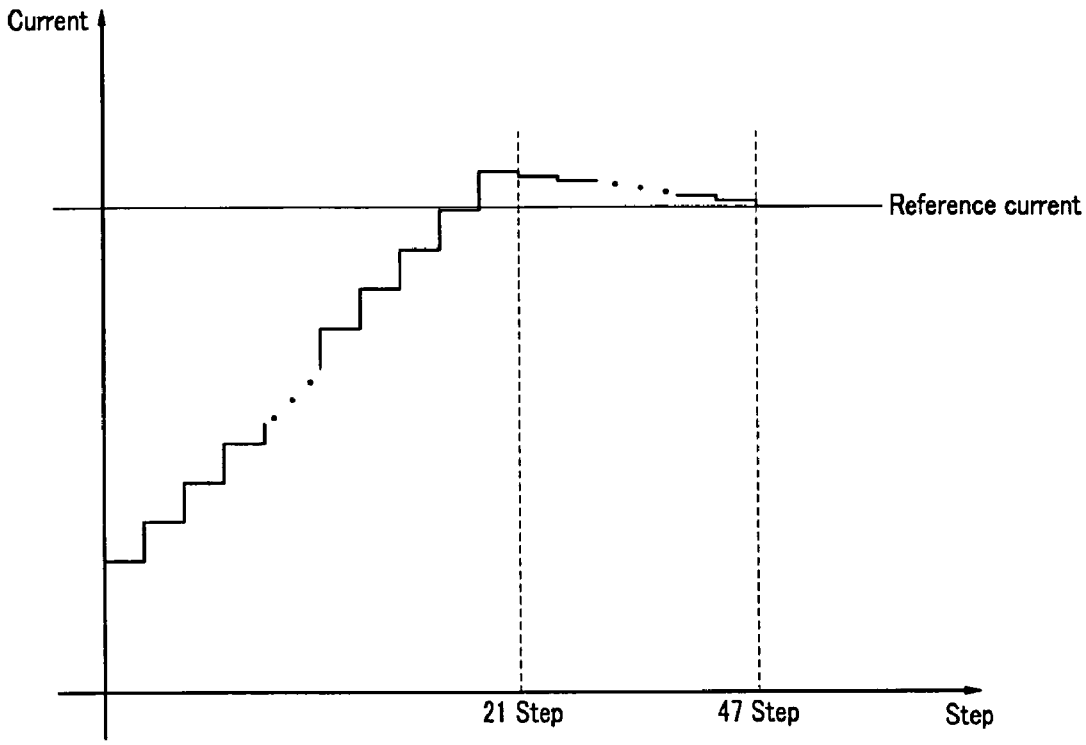
FIG. 5 illustrates a graph of changes in a current passing through a pixel element.

FIG. 4 illustrates a flowchart of operations in a method of controlling a power source according to a third example embodiment, and FIG. 5 illustrates a graph of changes in a current passing through a pixel element. The method may be used to control a power source voltage applied to a power line ELVDD. In an implementation, the method may separately control power source voltages applied to power lines ELVDD_R, ELVDD_G, and ELVDD_B.

Referring to FIG. 4, an amplified voltage output by a differential amplifier in the sensing unit 430 may be digitized by an ADC and input to the microprocessor 450 as a digital signal having a value Y. The microprocessor 450 may increase the value Y of the digital control signal input from the ADC by a first amount A, as indicated in section S100 of the flowchart, if the value Y is determined to be too low.

In detail, the first amount A may correspond to an increase in the power source voltage of a first voltage amount, i.e., the voltage on a power line ELVDD may be controlled as a function of Y, as indicated in section S200 of the flowchart. The increased digital signal (Y=Y+A) may then be output to the corresponding DAC. The converting unit 420 may generate the power source voltage according to the output of the DAC and transmit the power source voltage to the corresponding power line ELVDD via the sensing unit 430. Thus, where the value Y of the digital control signal is increased by the amount A, the power source voltage applied to the power line ELVDD may be increased by the first voltage amount.

As indicated in section S300 of the flowchart, the sensing unit 430 may sense a current I that flows through the power line ELVDD as a result of the power source voltage applied to the power line ELVDD. As indicated in section S400 of the flowchart, the controlling unit 480 may determine whether the sensed current I is greater than a reference value representing a reference current T for the corresponding color. In a display that includes sub-pixels of multiple colors, e.g., red, green, and blue, the reference current T, and thus the reference value, may be different for each color.

If the sensed current I is lower than the reference current T, the operations described above may be repeated, i.e., the microprocessor 450 may increment the value Y by the amount A. Thus, the operations described above in connection with sections S100 to S400 of the flowchart may be repeatedly performed, such that the power source voltage is continuously increased by the first voltage amount, thereby continuously incrementing the current I flowing through the power line ELVDD by a predetermined amount. For example, referring to FIG. 5, increments may result in a continual increase in the current I as shown through the first 21 steps in FIG. 5. The steps through step 21 shown in FIG. 5 may correspond to cycles through sections S100 to S400 in the flowchart illustrated in FIG. 4, i.e., one step of any of the steps up to step 21 may result from S100-S440 being performed once.

When the sensed current I flowing through the power line ELVDD becomes greater than the reference current T, i.e., due to the increments in the current I, the determination made by the controlling unit 480 in section S400 may result in the method passing to section S500 rather than returning to section S100.

As shown in section S500, the method may then determine whether the sensed current I is equal to the reference current T. If it is determined that the sensed current I is not equal the reference current T, i.e., if it is above the reference current T, the method may then pass to section S600. In this case, the microprocessor 450 may decrement the value Y of the digital control signal by a predetermined amount B, e.g., an amount of 1. The increment amount A may be greater the decrement amount B, and A may be greater than 1.

Referring to sections S700 and S800 of the flowchart, the converting unit 420 may generate the power source voltage according to the digital control signal as converted by the corresponding DAC, i.e., the converting unit 420 may generate the power source voltage to be applied to ELVDD as a function of the value Y (section S700), and may transmit the power source voltage to the corresponding power line ELVDD via the sensing unit 430 (section S700). In this case, since the value Y of the digital control signal may be reduced by, e.g., units of 1, the power source voltage applied to the power line ELVDD may be reduced by a second voltage amount, i.e., may be decremented step-wise by the second voltage amount. The sensing unit 430 may sense the current I flowing through the power line ELVDD, and sections S500 to S800 may be repeatedly performed until the sensed current I is the same as the reference current T. For example, referring to FIG. 5, the power source voltage, and thus the current flowing through the power line ELVDD, may be continuously reduced, i.e., decremented, in steps of the second voltage amount as sections S500 to S800 of the flowchart are repeatedly performed, and the current I flowing through the power line ELVDD may be correspondingly reduced in a continuous step-wise manner, as shown by the steps after step 21 and up to step 47 in FIG. 5.

In another implementation (not shown), decrementing the value Y may include repeated cycles of sections S400 to S800. Such an implementation may provide for a case where decrementing Y results in the sensed current I being less than the reference current T. In still another implementation (not shown), a predetermined tolerance, or window, may be provided around the reference value, such that I=T is satisfied when I is within the predetermined tolerance of T.

Referring again to section S500 of the flowchart, if it is determined in section S500 that the sensed current I is equal to the reference current T, the converting unit 420 may transmit the power source voltage corresponding to the power line ELVDD without changes to the power source voltage, i.e., the power source voltage may be established for the particular color, as indicated in section S900 of the flowchart.

The method described above may be implemented in a number of ways. For example, the method may be performed in connection with the display of a predetermined test pattern such as a particular color, a still image, or a video sequence, and may be performed during startup of the display, continuously or intermittently during operation of the display, etc. In an implementation, the signal controller 200 may output data for expressing a grayscale corresponding to a full white level during an initial driving of display. Accordingly, current may flow continuously through the power lines, thereby allowing the voltage(s) output by the power source to be quickly compensated. The method may be performed while the full white level is displayed, and after compensation of the power source voltages applied to the respective power lines ELVDD, the method may end.

As described above, the absolute value of the first voltage amount, i.e., the amount of increase in the power source voltage, may be greater than the absolute value of second voltage amount, i.e., the amount of decrease in the power source voltage. The first and second voltage amounts may be functions of the respective increment amount A and decrement amount B used in the microprocessor 450. Further, A may be greater than B. Accordingly, when the current flowing through the power line is reduced due to deterioration of the electroluminescent element driven by the pixel circuit, the power source voltage may be quickly increased until a current that is greater than the reference current flows in the power line. In addition, after the power source voltage is quickly increased, the power source voltage may be precisely reduced until the desired reference current flows in the power line. Thus, deterioration in the performance or efficiency of an electroluminescent element such as an OLED may be quickly and precisely compensated. Further, since the display may apply data for expressing grayscale corresponding to the full white level in the initial driving, the display may be used with an analog driving method.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A power source for applying a voltage to a pixel circuit having first and second power lines coupled thereto, the first power line applying a first voltage that is higher than a second voltage applied by the second power line, the first power line supplying the first voltage to an anode of a light emitting element in the pixel circuit, the power source comprising:

a sensing unit; and a controlling unit, wherein:

the sensing unit senses a current flowing to the pixel circuit, and the controlling unit increases the first voltage applied to the first power line until the sensed current is greater than a reference and then decreases the first voltage applied to the first power line so as to bring the sensed current down, the controlling unit increasing the first voltage applied to the first power line by a first amount when the sensed current is lower than the reference, and subsequently decreasing the first voltage applied to the first power line by a second amount to decrease the sensed current from a first level higher than the reference to a second level that is closer to the reference, the second amount being less than the first amount, an absolute value of increments to the first voltage applied to the first power line being larger than an absolute value of decrements to the first voltage applied to the first power line.

2. The power source as claimed in claim 1, wherein the power source applies a first first voltage to a first first power line coupled to first pixel circuits corresponding to first light emitting elements for emitting a first color, and applies a second first voltage to a second first power line coupled to second pixel circuits corresponding to second light emitting elements for emitting a second color.

3. The power source as claimed in claim 2, wherein:

the sensing unit senses a first current flowing through the first first power line coupled to the first pixel circuits, and senses a second current flowing through the second first power line coupled to the second pixel circuits, the controlling unit compares the first sensed current to a first reference, and compares the second sensed current to a second reference, the controlling unit controlling increases and decreases in the first first voltage and the second first voltage according to the comparisons, and the power source includes a converting unit that is controlled by the controlling unit, the converting unit increasing and decreasing the first first voltage and the second first voltage in response to the controlling unit.

4. The power source as claimed in claim 3, wherein:

the controlling unit controls the converting unit to increase the first first voltage by the first amount when the first sensed current is less than the first reference, and the controlling unit controls the converting unit to increase the second first voltage by the first amount when the second sensed current is less than the second reference.

5. The power source as claimed in claim 4, wherein:

the controlling unit controls the converting unit to decrease the first first voltage by the second amount when the first sensed current is greater than the first reference, and the controlling unit controls the converting unit to decrease the second first voltage by the second amount when the second sensed current is greater than the second reference.

6. The power source as claimed in claim 1, wherein:

the power source includes a converting unit that is controlled by the controlling unit, the converting unit increasing and decreasing the first voltage in response to the controlling unit, the sensing unit includes a resistor coupled between an output of the converting unit and the power line, the sensing unit includes an amplifier that outputs an output voltage corresponding to a voltage difference between two terminals of the resistor, and the controlling unit receives the output voltage.

7. The power source as claimed in claim 6, wherein:

the controlling unit increases a signal transmitted to the converting unit when the sensed current is lower than the reference and decreases the signal transmitted to the converting unit when the sensed current is higher than the reference; and the converting unit increases and decreases the first voltage applied to the power line in correspondence with increases and decreases in the signal transmitted by the controlling unit.

8. A display, comprising:

a pixel circuit;

a first power line coupled to the pixel circuit between the pixel circuit and a power source, the first power line supplying a first voltage to an anode of a light emitting element in the pixel circuit, the power source including a sensing unit and a controlling unit; and a second power line coupled to the pixel circuit, the first voltage being higher than a second voltage applied by the second power line, wherein:

the sensing unit senses a current flowing to the pixel circuit, and the controlling unit increases the first voltage applied to the first power line until the sensed current is greater than a reference and then decreases the first voltage applied to the first power line so as to bring the sensed current down, the controlling unit increasing the first voltage applied to the first power line by a first amount when the sensed current is lower than the reference, and subsequently decreasing the first voltage applied to the first power line by a second amount when the sensed current is higher than the reference, the second amount being less than the first amount, an absolute value of increments to the first voltage applied to the first power line being larger than an absolute value of decrements to the first voltage applied to the first power line.

9. The display as claimed in claim 8, wherein the power source applies a first first voltage to a first power line coupled to first pixel circuits corresponding to first light emitting elements for emitting a first color, and applies a second first voltage to a second power line coupled to second pixel circuits corresponding to second light emitting elements for emitting a second color.

10. The display as claimed in claim 9, wherein:

the sensing unit senses a first current flowing through the first first power line coupled to the first pixel circuits, and senses a second first current flowing through the second first power line coupled to the second pixel circuits, and the controlling unit compares the first sensed current to a first reference, and compares the second sensed current to a second reference, the controlling unit controlling increases and decreases in the first first voltage and the second first voltage according to the current comparisons, and further comprising a converting unit controlled by the controlling unit, the converting unit increasing and decreasing the first first voltage and the second first voltage in response to the controlling unit.

11. The display as claimed in claim 10, wherein:

the controlling unit controls the converting unit to increase the first first voltage by the first amount when the first sensed current is less than the first reference, and the controlling unit controls the converting unit to increase the second first voltage by the first amount when the second sensed current is less than the second reference.

12. The display as claimed in claim 11, wherein:

the controlling unit controls the converting unit to decrease the first first voltage by the second amount when the first sensed current is greater than the first reference, and the controlling unit controls the converting unit to decrease the second first voltage by the second amount when the second sensed current is greater than the second reference.

13. A method of controlling a voltage applied to a pixel circuit having first and second power lines coupled thereto, the first power line applying a first voltage that is higher than a second voltage applied by the second power line, the first power line supplying the first voltage to an anode of a light emitting element in the pixel circuit, the method comprising:

sensing a current flowing to the pixel circuit;

increasing the first voltage applied to the first power line until the sensed current is greater than a reference and then decreasing the first voltage applied to the first power line so as to bring the sensed current down from a first level that is higher than the reference to a second level that is closer to the reference, the first voltage applied to the first power line being increased by a first amount when the sensed current is lower than the reference, and subsequently being decreased by a second amount when the sensed current is higher than the reference, the second amount being less than the first amount, an absolute value of increments to the first voltage applied to the first power line is larger than an absolute value of decrements to the first voltage applied to the first power line.

14. The method as claimed in claim 13, wherein:

a first first voltage is applied to a first first power line, a second first voltage is applied to a second first power line, the power source is coupled to the first first power line, the first first power line being coupled to first pixel circuits that correspond to first light emitting elements for emitting a first color, and the power source is coupled to the second first power line, the second first power line being coupled to second pixel circuits corresponding to second light emitting elements for emitting a second color.

15. The method as claimed in claim 14, wherein sensing the current includes sensing a first current flowing through the first first power line and sensing a second current flowing through the second first power line, the method further comprising:

comparing the first sensed current to a first reference;

comparing the second sensed current to a second reference; and controlling increases and decreases in the first first voltage and the second first voltage according to the comparisons.

16. The method as claimed in claim 15, wherein:

the first first voltage is increased by the first amount when the first sensed current is less than the first reference, and the second first voltage is increased by the first amount when the second sensed current is less than the second reference.

17. The method as claimed in claim 16, wherein:

the first first voltage is decreased by the second amount when the first sensed current is greater than the first reference, and the second first voltage is decreased by the second amount when the second sensed current is greater than the second reference.

* * * * *